US007228670B2

(12) United States Patent
Ollman

(10) Patent No.: US 7,228,670 B2
(45) **Date of Patent: *Jun. 12, 2007**

(54) STRUCTURAL TRUSS AND METHOD OF MAKING SAME

(76) Inventor: Melvin L. Ollman, P.O. Box 1370, Marco Island, FL (US) 34146

( * ) Notice: Subject to any disclaimer, the term of this patent is extended or adjusted under 35 U.S.C. 154(b) by 192 days.

This patent is subject to a terminal disclaimer.

(21) Appl. No.: 10/919,601

(22) Filed: Aug. 17, 2004

(65) Prior Publication Data

US 2005/0055951 A1 Mar. 17, 2005

Related U.S. Application Data

(60) Provisional application No. 60/496,067, filed on Aug. 18, 2003.

(51) Int. Cl.
*E04B 1/18* (2006.01)

(52) U.S. Cl. ..... 52/633; 52/694; 52/634; 52/637

(58) Field of Classification Search ..... 52/634, 52/644, 653.2, 637, 633, 694; 29/897.3, 29/897.31, 897.312
See application file for complete search history.

(56) References Cited

U.S. PATENT DOCUMENTS

| | | | | |
|---|---|---|---|---|
| 1,911,018 | A * | 5/1933 | Goeltz | 52/648.1 |
| 2,284,898 | A * | 6/1942 | Hartman | 52/654.1 |
| D230,265 | S | 2/1974 | Ollman | |
| 3,827,117 | A | 8/1974 | Ollman | |
| 3,845,594 | A * | 11/1974 | Butts et al. | 52/98 |
| 3,882,653 | A | 5/1975 | Ollman | |
| 3,961,738 | A | 6/1976 | Ollman | |
| 4,030,256 | A | 6/1977 | Ollman | |
| 2005/0055951 | A1 * | 3/2005 | Ollman | 52/633 |

* cited by examiner

*Primary Examiner*—Carl D. Friedman
*Assistant Examiner*—Basil Katcheves
(74) *Attorney, Agent, or Firm*—The Livingston Firm; Edward M. Livingston; Angela M. Miller

(57) ABSTRACT

An improved structural truss (3) and method of making same having oppositely disposed U-shaped channel chords (2) and struts (1) interconnected to one another at alternately extending apices (6) wherein the apices (6) form an inverted U-shape at a cross-section at the center of the strut (1). The ends (4) of successive segments of the unit lengths of the struts (1) and the chords (2) have holes for the insertion of a tapered pin (9), thus precisely controlling the length of successive trusses. The truss member (3) also has vertical load-bearing strut sections (17) at the end of each manufactured length of truss (3) to support a cantilevered section of chord (10).

5 Claims, 3 Drawing Sheets

STRUCTURAL TRUSS AND METHOD OF MAKING SAME

CROSS REFERENCE TO RELATED APPLICATION

This application claims the benefit of U.S. Provisional Application No. 60/496,067, filed Aug. 18, 2003.

BACKGROUND OF THE INVENTION

This invention relates to trusses, more specifically, an improved open web structural truss and process of making same.

Conventional structural trusses and methods of making same are difficult in some respects.

First, the truss members of predetermined length, as described in U.S. Pat. No. 3,827,117, comprise oppositely disposed U-shaped channels between which a strut member is positioned, comprising alternately extending strut segments having flat end portions which are generally U-shaped in a cross section at the center and gradually tapering toward the flat end portions at the end. The strut member is then bent at the flat portions to form alternately extending apices which contact the opposing chord elements. When this is done, however, the apices become substantially different in shape, thereby materially affecting the quality of their connections to the opposing chords. Thus, there exists a need for improvement in the quality of those connections.

Second, current production machines for the manufacturing of trusses, as described in U.S. Pat. Nos. 3,827,117 and 3,961,738, teach using preset lengths and quantities of trusses being formed continuously on the production machinery as controlled by a computer program. Although these machines efficiently manufacture the truss members described in the cited prior art at low cost with a minimum of labor and in a manner to provide uniformity and quality, these machines do not provide the following capabilities: a) providing a means for precise location for fastening struts and chords, b) providing a means for precisely measuring the distance points from apex to apex, and c) providing a vertical member for the support of the cantilevered ends of each truss length.

The prior art includes the following United States patents:

| U.S. Pat. No. | Inventor | Assignee | Filing Date | Issue Date |
|---|---|---|---|---|
| D230,265 | Ollman | C-O, Inc. | Aug. 11, 1971 | Feb. 05, 1974 |
| 3,882,653 | Ollman | C-O, Inc. | Mar. 16, 1973 | May 13, 1975 |
| 3,827,117 | Ollman | C-O, Inc. | Apr. 11, 1973 | Aug. 06, 1974 |
| 3,961,738 | Ollman | C-O, Inc. | Jul. 01, 1974 | Jun. 08, 1976 |
| 4,030,256 | Ollman | N/A | Nov. 20, 1975 | Jun. 21, 1977 |

SUMMARY OF THE INVENTION

The primary object of the present invention is to provide an improved structural truss that will provide for improved connections of apices to the opposing chords.

A further object of the present invention is to provide an improved apparatus for making identically shaped strut apices contacting each of the opposing truss chords.

An even further object of the present invention is to provide an improved apparatus for making truss members which provides a means for precisely measuring the distance points from apex to apex.

A further object of the present invention is to provide an improved apparatus for making truss strut members which provides a load-bearing vertical member for the support of the cantilevered end of each truss.

The present invention fulfills the above and other objects by providing two improved strut segments where one strut segment is inverted U-shaped and the other is U-shaped. By having segments with both a U-shape and inverted U-shape, those portions of the strut contacting the opposing chords will have identically-shaped flat sections to facilitate the joining of the strut and the chords.

The present invention further fulfills the above objectives by providing a method for making truss members to form the U-shaped sections of the advancing strut forms alternate U-shape and inverted U-shaped sections of each segment in the strut unit length. The method invention involves providing unit length standards for both strut and chord by punching identically sized and located holes at each segment end of successive unit lengths of struts and of chords. As the separate elements of strut and chords reach the point of joining one to the other, a tapered pin will align the strut and chord by entering a first hole on the chord and then a second hole on the strut to precisely align the elements at a prescribed standard unit length. In addition, terminating strut section of each truss is truncated to form vertical load-bearing strut segments for the preceding and succeeding trusses.

The above and other objects, features, and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to a description of a preferred embodiment with reference to the following drawings which are explained briefly as follows:

DESCRIPTION OF PREFERRED EMBODIMENT

Listed numerically below with reference to the drawings are terms used to describe features of this invention. These terms and numbers assigned to them designate the same features throughout this description.

| | |
|---|---|
| 1. | strut member |
| 2. | u-shaped channel/chord |
| 3. | truss member |
| 4. | flat end portion |
| 5. | intermediate portion |
| 6. | apex |
| 7. | open end |

-continued

| | |
|---|---|
| 8. | closed end |
| 9. | pin |
| 10. | end of chord |
| 11. | notch |
| 12. | cantilevered end |
| 13. | hollow rivet |
| 14. | middle |
| 15. | first end |
| 16. | second end |
| 17. | end strut member |
| 18. | hole |

Figure 1:
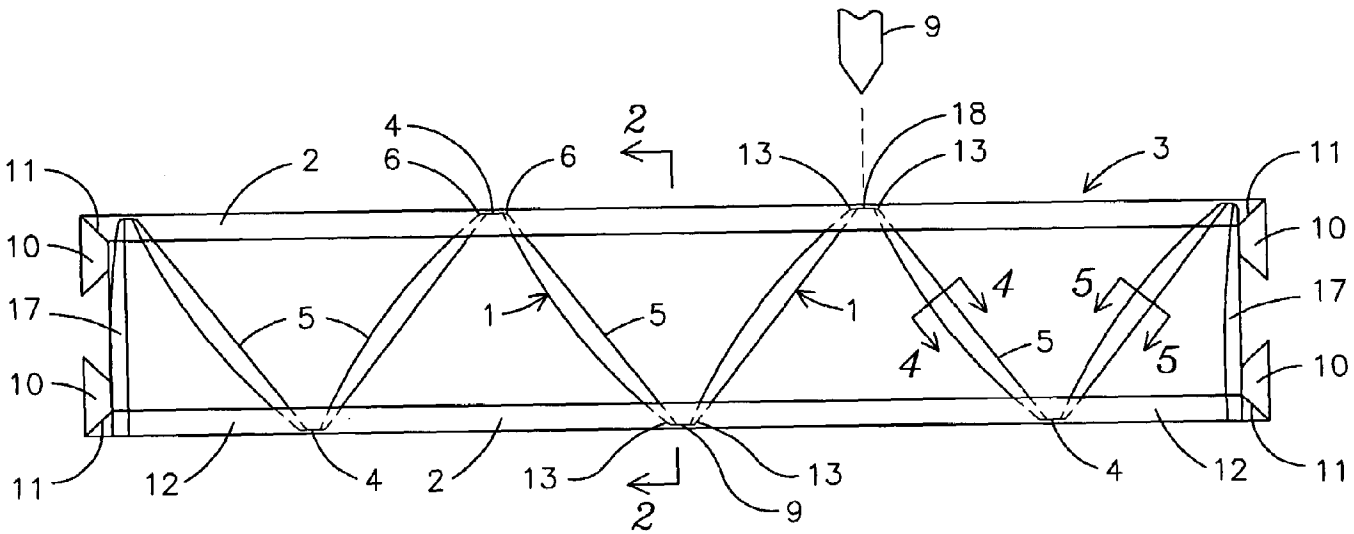
FIG. 1 is a side elevational plan view of the present invention.
Figure 2:
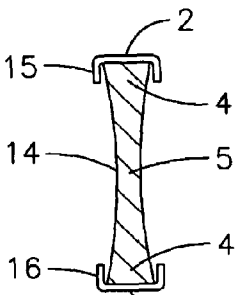
FIG. 2 is a cross sectional view along the line 2-2 of the embodiment of FIG. 1.

With reference to FIGS. 1 and 2, an improved structural truss of the present invention is shown. The improved truss has a plurality of strut members 1 having a first end 15, a middle 14 and a second end 16. The struts 1 have flat end portions 4 on the first end 15 and the second end 16 and are connected by non-flat intermediate portions 5 which are U-shaped or inverse U-shaped. The strut member 1 is bent at the flat portions 4 to form alternately extending apices 6. The apices 6 of the strut members 1 are connected to the U-shaped channels 2 to form the truss member 3. The U-shaped chord channels 2 have notches 11 punched out in equal distances from one another. The notches 11 are adjacent to the end pieces 6 of the truss member 3 and provide for bending the ends 10 of the chord channels 2 inward around an end strut member 17 to define and provide strength to each truss member 3. The strut apex 6 and each adjacent point of the chords 2 have holes 18 to accommodate a tapered pin 9. The tapered pins 9 are used to precisely locate the end points of each unit length of the truss member 3. Each truss member 3 has cantilevered ends 12 to form each truss member 3. Apices 6 of the strut 1 will be secured to each chord 2 by using a fastening means, such as a hollow rivet 13 located on both sides of the pins 9. The last strut members 17 on each end in a truss member 3 is bent perpendicularly to the chord 2 and the ends of each chord 10 are bent at a notch 11 to provide closed ends to the truss members 3.

Figure 3:
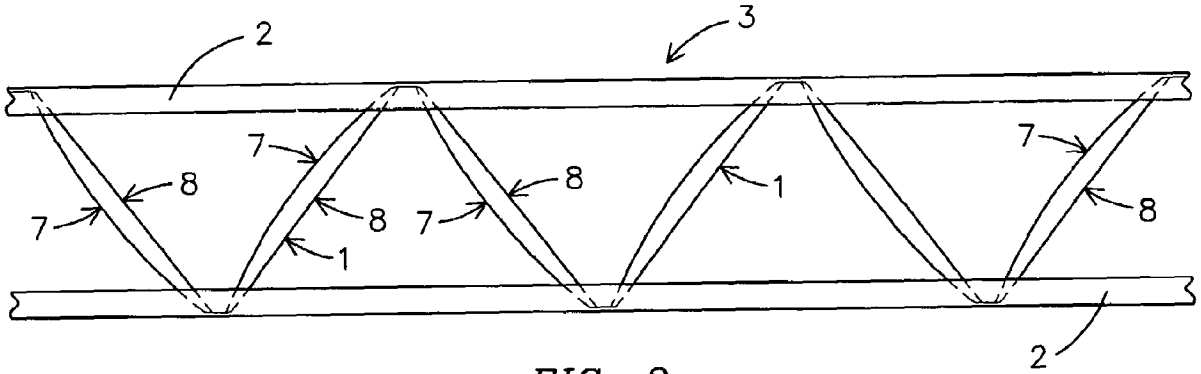
FIG. 3 is a side view of the improved truss of the present invention as a strut is inserted between the chords.

In FIG. 3, truss member 3 is shown with the strut member 1 inserted between the chords 2. The U-shaped portions of the struts 1 alternate in different directions, an open end 7 and a closed end 8, so that those portions of the strut members 1 contacting the chord 2 will be identical in shape.

Figure 5:
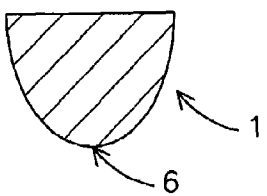
FIG. 5 is a cross sectional view along the line 5-5 of the embodiment of FIG. 1.
Figure 4:
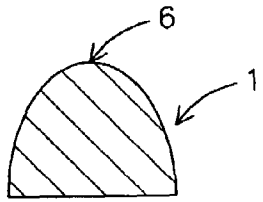
FIG. 4 is a cross sectional view along the line 4-4 of the embodiment of FIG. 1.

With reference to FIGS. 4 and 5, cross sectional views of alternating strut members 1 are shown to have inverse U-shaped and U-shaped features, respectively. This feature achieves a higher quality of strut member 1 to chord 10 connection by creating identically shaped apices 6. The flat end portion 4 has a hole 18 to accommodate a tapered pin 9.

Figure 6:
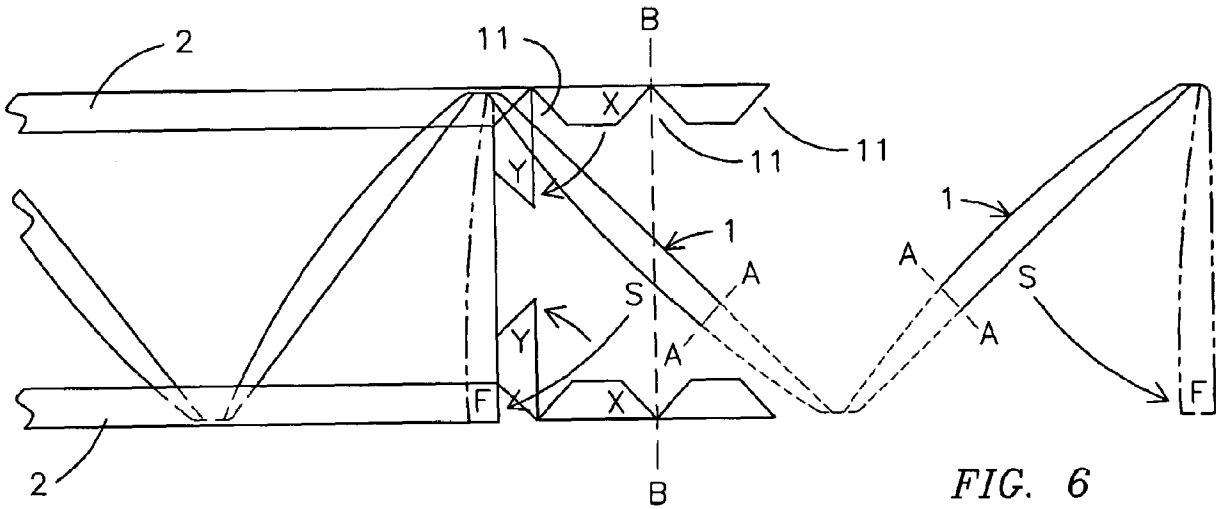
FIG. 6 is a cutaway side view of the present invention illustrating the operations performed on a cut strut and cut channel of the present invention.

With reference to FIG. 6, the method employed in fabricating the truss members of the present invention is described. First, a cut is made on the strut member 1 along lines A-A. The cut struts 17 are then folded from positions S to positions F. Then, another cut is made along line B-B through the U-shaped chord 2. Because the strut 1 was already folded, the cut along B-B will not cut the strut members 1. The U-shaped channel chords ends 10 are then bent from positions X to positions Y to form the truss member 1.

Figure 7:
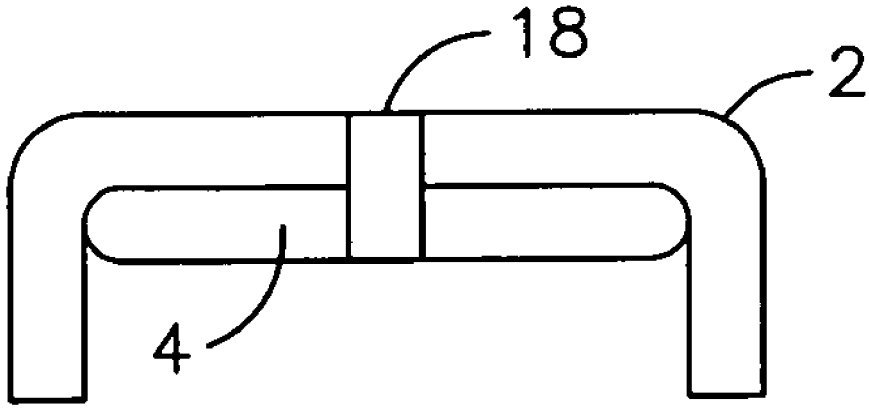
FIG. 7 is a cross-sectional view along the line 7-7 of the embodiment of FIG. 1.

Finally, with reference to FIG. 7, a cross-sectional view along line 7-7 of the embodiment of FIG. 1 is shown. The hole 18 is located on the strut apex 6 and each adjacent point of the chords 2 to accommodate a tapered pin 9 for proper alignment of the struts 1 and chords 2.

The use of the present invention will improve the quality of the strut member to chord element connection.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

I claim:

1. An improved structural truss comprising:

at least two strut members having at least two alternately extending struts;

said at least two alternately extending struts having a first end, a middle and a second end;

said at least two alternately extending struts having a flat end portion on said first end and a flat end portion on said second end;

said flat end portion on said first end is connected to said flat end portion on said second end by at least one first non-flat intermediate portion and at least one second non-flat intermediate portion;

said at least one first non-flat intermediate portion is U-shaped;

said at least one second non-flat intermediate portion is inverse U-shaped;

said at least two flat end portions are fastened to at least two chords;

said at least two chords are parallel in relation to one another;

at least two extending struts are bent at said at least two flat portions to form a pair of alternately extending apices;

said apices have at least one hole;

said at least two chords have at least one hole; and a pin that is inserted into said at least one hole in said apices and said at least one hole in said at least two chords.

2. The improved structural truss of claim 1 wherein:

said at least two chords have at least one notch per chord.

3. The improved structural truss of claim 2 wherein:

said at least one notch per chord is adjacent to said apices located on said at least two extending struts.

4. The improved structural truss of claim 1 wherein:

said at least two chords are substantially U-shaped.

5. A method for making an improved structural truss comprising at least two strut members having at least two alternately extending struts; said at least two alternately extending struts having a first end, a middle and a second end; said at least two alternately extending struts having a flat end portion on said first end and a flat end portion on said second end; said flat end portion on said first end is connected to said flat end portion on said second end by at least one first non-flat intermediate portion and at least one second non-flat intermediate portion; said at least one first non-flat intermediate portion is U-shaped; said at least one second non-flat intermediate portion is inverse U-shaped; said at least two flat end portions are fastened to at least two chords; said at least two chords are parallel in relation to one another; at least two extending struts are bent at said at least two flat portions to form a pair of alternately extending apices; said apices have at least one hole; said at least two chords have at least one hole; and a pin that is inserted into said at least one hole in said apices and said at least one hole in said at least two chords, said method comprising the steps of:

a. at least partially cutting one said strut at a distance between said middle and said second end;

b. punching a hole at each segment end of successive unit lengths of struts and chords;

c. aligning the struts and chords;

d. inserting the pin into the hole on the chord and the hole on the strut to position the struts and chords at a prescribed standard unit length;

e. positioning the one said strut at an end of each truss so it is substantially perpendicular to and positioned between the chords; and f. folding ends of the cut chords so they are substantially perpendicular to and positioned between the chords.

* * * * *